US007347415B2

(12) United States Patent
Shin

(10) Patent No.: US 7,347,415 B2
(45) Date of Patent: Mar. 25, 2008

(54) PAPER FEEDING APPARATUS OF IMAGE FORMING APPARATUS

(75) Inventor: Hwa-sung Shin, deceased, late of Suwon (KR); by Jeung-ok Choi, legal representative, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 161 days.

(21) Appl. No.: 10/658,603

(22) Filed: Sep. 10, 2003

(65) Prior Publication Data

US 2004/0124578 A1 Jul. 1, 2004

(30) Foreign Application Priority Data

Sep. 13, 2002 (KR) ..... 10-2002-0055812

(51) Int. Cl.
*B65H 3/54* (2006.01)

(52) U.S. Cl. ..... 271/170; 271/171; 347/104

(58) Field of Classification Search ..... 271/24, 271/30.1, 128, 147, 148, 22, 156, 171, 129, 271/149, 9.09, 170, 126; 400/624, 632.1
See application file for complete search history.

(56) References Cited

U.S. PATENT DOCUMENTS 2,893,729 A * 7/1959 Perzentka ..... 271/21
RE25,825 E * 7/1965 Springer ..... 271/170
4,363,477 A * 12/1982 Miyashita ..... 271/9.09
4,772,007 A * 9/1988 Kashimura ..... 271/22
4,786,042 A * 11/1988 Stemmle ..... 271/9.1
5,096,182 A * 3/1992 Kashimura ..... 271/170
5,437,444 A * 8/1995 Kawakami et al. ..... 271/22
5,615,873 A * 4/1997 Kobayashi et al. ..... 271/121
5,934,667 A * 8/1999 Miki ..... 271/152
6,305,682 B1 * 10/2001 Saito et al. ..... 271/10.11

FOREIGN PATENT DOCUMENTS

EP 0524646 * 1/1993
JP 58-17028 * 2/1983

(Continued)

OTHER PUBLICATIONS

Chinese Office Action in Chinese Application No. 03158857.3.

*Primary Examiner*—Patrick Mackey
*Assistant Examiner*—Thomas Morrison
(74) *Attorney, Agent, or Firm*—Staas & Halsey LLP

(57) ABSTRACT

A paper feeding apparatus of an image forming apparatus has a paper setting unit that includes a knock-up plate raising/lowering portion raising and lowering a knock-up plate with respect to a pickup roller, a paper guide slidably formed on the knock-up plate to guide papers in accordance with a paper size, and a finger device portion formed on both sides of the frame to press both corners of a leading end of a paper when the paper is picked up by the pickup roller, thereby causing the papers to be separated and fed sheet by sheet. By providing the finger device portion that presses both corners of the leading end of the paper with a predetermined pressure, the papers can be picked up and fed sheet by sheet, and undesired phenomenon, such as paper jam, and double-, or multi-sheet feed, can be prevented.

3 Claims, 12 Drawing Sheets

FOREIGN PATENT DOCUMENTS

| | | | |
|---|---|---|---|
| JP | 2-75533 | * | 3/1990 |
| JP | 4-66439 | * | 3/1992 |
| JP | 4-217530 | * | 8/1992 |
| JP | 4-292344 | * | 10/1992 |
| JP | 5-24699 | * | 2/1993 |
| JP | 5-254672 | * | 10/1993 |

* cited by examiner

PAPER FEEDING APPARATUS OF IMAGE FORMING APPARATUS

CROSS-REFERENCE TO RELATED APPLICATIONS

This application claims the benefit of Korean Application No. 2002-55812, filed Sep. 13, 2002, in the Korean Intellectual Property Office, the disclosure of which is incorporated herein by reference.

BACKGROUND OF THE INVENTION

1. Field of the Invention

The present invention generally relates to a paper feeding apparatus for use in an image forming apparatus including an office machine such as an inkjet printer, and more particularly, to a paper feeding apparatus which has a finger device portion that presses both corners of a leading end of a sheet of paper with a predetermined pressure in an image forming apparatus, thereby enabling a pickup device to accurately pick-up papers sheet-by-sheet and preventing an undesirable phenomenon, such as a paper jam or double-or multi-sheet feed, during a paper pickup process.

2. Description of the Related Art

FIG. 1 shows a general paper feeding apparatus 1 of an inkjet printer, which is provided with a frame 10, serving as a paper stack or a paper tray, obliquely mounted on a rear or upper side of the printer to receive a plurality of paper sheets thereon, a pickup portion 20 mounted on an upper side of the frame 10 to pickup and feed the paper sheets from the paper stack on the frame 10, and a paper setting unit 30 aligning the paper sheet on the frame 10 so as to prevent an undesirable movement of the paper sheets and guarantee feeding of the paper sheets sheet by sheet.

The frame 10 is provided with a knock-up plate 11 which is resiliently supported by a knock-up spring (not shown).

The pickup portion 20 includes a pickup roller 22 which is disposed on a shaft 21 connected with a gear train (not shown) that transmits a driving force from a motor (not shown).

The paper setting unit 30 includes a release lever 12 rotatably mounted on a side of the frame 10 to be moved in association with the knock-up plate 11, a finger portion 14 arranged on a lower portion of the release lever 12 to press on the paper sheet at a right corner of a leading end for an accurate separation of the paper sheets one by one, and a paper guide 25 movable leftward and rightward along the knock-up plate 11.

An operation of the conventional paper feeding apparatus 1 constructed as above will be described.

First, for easy stacking the papers on the knock-up plate 11 of the frame 10 that serves as the paper tray, the release lever 12 is clockwise rotated. As a result, the release lever 12 pushes the knock-up plate 11 downward by a first locking member (not shown) thereof and by a second locking member (not shown) thereof a makes the finger portion 14 to move away from the knock-plate 11 against a recovering force of a tension spring 19.

Next, the paper sheets are stacked on the knock-up plate 11 of the frame 10, and the paper guide 25 is adjusted. Then the release lever 12 is rotated counterclockwise.

As a result, when the knock-up plate 11 is released from a pressing force of the first locking member of the release lever 12, the knock-up plate 11 is raised by a recovering force of the knock-up spring to press the paper sheet with a predetermined pressure to be in contact with the pickup roller 22.

Also, when the finger portion 14 is released from a pressing force of the second locking member of the release lever 12, the finger portion 14 is counterclockwise rotated about a hinge axle 17*a* by the recovering force of the tension spring 19. Accordingly, a certain side of the paper sheets, i.e., a right corner of the paper sheets in this instance, is pressed by a claw (not shown) of the finger portion 14 being pressed towards the knock-up plate 11.

Then, with a rotation of the pickup roller 22, the paper sheet is released from the claw with a predetermined friction and fed into the printer.

Conventionally, since the finger portion 14 of the paper setting unit 30 is arranged only with respect to the right corner of the leading end of the paper sheets, the paper sheet is skewed with respect to a left side of the paper sheet that does not contact the finger portion 14 when the paper sheet is picked up by the pickup roller 22.

Due to the paper skew, an image is improperly printed on the paper sheet. Also, as the paper sheet skews, the paper sheet is easily caught in rollers such as a transport roller, resulting in a paper jam.

There is another drawback of having the finger portion 14 at only one side of the paper stack. That is, as the paper stack is kept in the frame 10 for a long time, due to a paper weight, a temperature and humidity, the paper stack gravitates toward the left side where there is no finger portion 14, resulting in an impairment in the paper feeding, such as the paper jam, multi-sheet feed, or the like.

SUMMARY OF THE INVENTION

Accordingly, it is an aspect of the present invention to provide a paper feeding apparatus of an image forming apparatus, such as an office machine, which has a finger device portion that presses on left and right corners of a leading end of a paper sheet so that paper sheets can be picked up one by one, thereby preventing an undesirable phenomenon during a pickup process, such as paper jam, double-or multi-sheet feed, or the like.

It is another aspect of the present invention to provide a paper feeding apparatus of an image forming apparatus, such as an office machine, which has a finger device portion having a finger portion moving in association with a paper guide, so as to constantly press left and right corners of a leading end of the paper sheet with a predetermined pressure regardless of a size of paper sheets being used.

Additional aspects and advantages of the invention will be set forth in part in the description which follows and, in part, will be obvious from the description, or may be learned by practice of the invention.

According to another aspect of the present invention, a paper feeding apparatus of an image forming apparatus, such as an office machine, includes a paper setting unit having a knock-up plate raising/lowering portion raising and lowering a knock-up plate with respect to a pickup roller, a paper guide slidably formed on the knock-up plate to guide papers in accordance with a paper size, and a finger device portion formed to be operated by the knock-up plate raising/lowering portion and the paper guide on both sides of a frame so as to press both corners of a leading end of a paper when the paper is picked up by the pickup roller, thereby causing the papers to be separated and fed sheet by sheet.

The finger device portion includes a first finger portion formed on one side of the frame with respect to the knock-up plate raising/lowering portion to press one corner of the leading end of the papers, and a second finger portion formed on the other side of the frame with respect to the paper guide to press the other corner of the leading end of the papers.

The first finger portion includes a first operating lever disposed on the frame to move toward or spaced away from the knock-up plate when the knock-up plate is raised or lowered by the knock-up plate raising/lowering portion, and a first resilient returning member disposed between the frame and the first operating lever to return the operating lever towards the knock-up plate when the knock-up plate is raised by the knock-up plate raising/lowering portion.

The first operating lever includes a first hinge portion hingedly supported on the frame, a first claw formed to press the one corner of the leading end of the papers, and a first operating member formed in a vicinity of the first hinge portion to move the first lever member close toor away from the knock-up plate when the knock-up plate is raised or lowered by the knock-up plate raising/lowering portion.

The first resilient returning member includes a resilient spring arranged between the frame and the first operating lever.

The second finger portion includes a second operating lever disposed on the paper guide to be spaced away from the knock-up plate when the knock-up plate is spaced away from the pickup roller by more than a predetermined distance, and a second resilient returning member disposed between the paper guide and the second operating lever to resiliently return the second operating lever towards the knock-up plate when the knock-up plate is raised to a vicinity of the pickup roller.

The second operating lever includes a second hinge portion hingedly supported on the paper guide, a second claw formed to press the other corner of the leading end of the papers, and a second operating member formed in a vicinity of the second hinge portion to be spaced by the predetermined distance from the frame so as to allow the second operating member to be positioned at a wider gap with the knock-up plate when the knock-up plate is spaced away from the pickup roller, the wider gap being widened by a distance that the knock-up plate is spaced away from the pickup roller. The predetermined distance between the frame and the second operating member is adjusted depending on a position of a stopper portion which is formed on the paper guide to restrict a movement of the second operating member by the second resilient returning member.

The second resilient returning member includes a tension spring secured between an end of the second operating member and the paper guide.

The paper setting unit further includes a finger raising/lowering device portion preventing the second finger portion from being blocked from further advancing by the other corner of the leading end of the papers when the paper guide is moved to guide the papers with the knock-up plate being raised by the knock-up plate raising/lowering portion.

The finger raising/lowering device portion includes at least one operating rib formed on the frame with respect to the second operating member to raise the second operating member of the second operating lever against a recovering force of the second resilient returning member when the paper guide is drawn near to a side of the papers, and causing the second operating member of the second operating lever to be pulled by the second resilient returning member so that the second claw is in contact with the papers with a predetermined pressure when the paper guide is in contact with the side of the papers.

The operating rib includes two symmetrical inclined surfaces which are arranged in a perpendicular relationship with an advancing direction of the second operating member within a range of an advancing movement of the second operating member and are inclined at a predetermined angle in the advancing direction of the second operating member.

The operating rib includes a plurality of operating sub-ribs arranged along the side of each type of the papers being used in the office machine according to a paper size of the papers.

According to another aspect of the present invention, a paper feeding apparatus of an image forming apparatus including an office machine includes a paper setting unit having a paper guide slidably formed on a knock-up plate to guide papers in accordance with a paper size, and a finger portion formed to operate in combination with the paper guide so as to press at least a corner of a leading end of a paper positioned at a side of the paper guide.

The finger portion includes an operating lever disposed on the paper guide to be spaced away from the knock-up plate when the knock-up plate is spaced away from a pickup roller by more than a predetermined distance, and a resilient returning member disposed between the paper guide and the second operating lever to resiliently return the second operating lever towards the knock-up plate when the knock-up plate is raised to a vicinity of the pickup roller.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
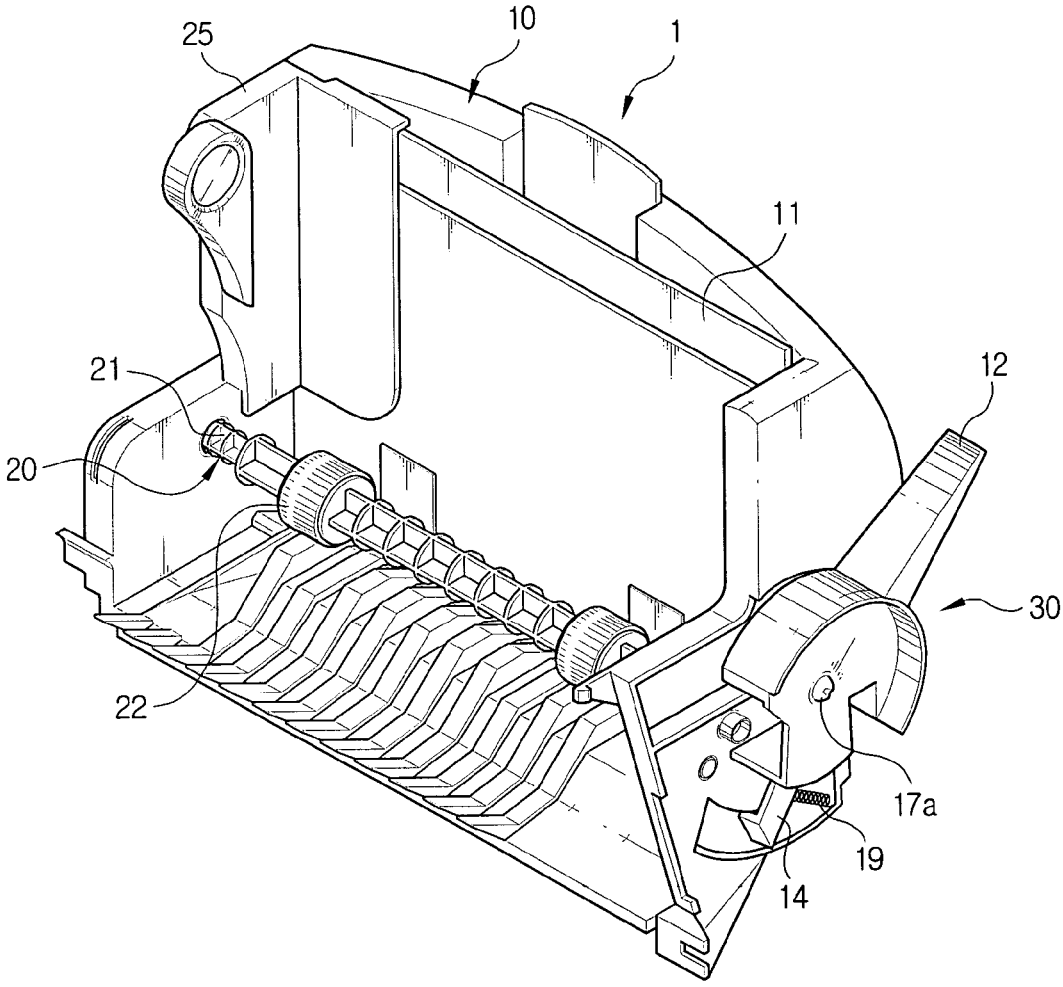
FIG. 1 (PRIOR ART)
FIG. 1 is a perspective view of a conventional paper feeding apparatus of an office machine.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures. Hereinafter, the present invention will be described in detail with reference to the accompanying drawings.

Figure 2:
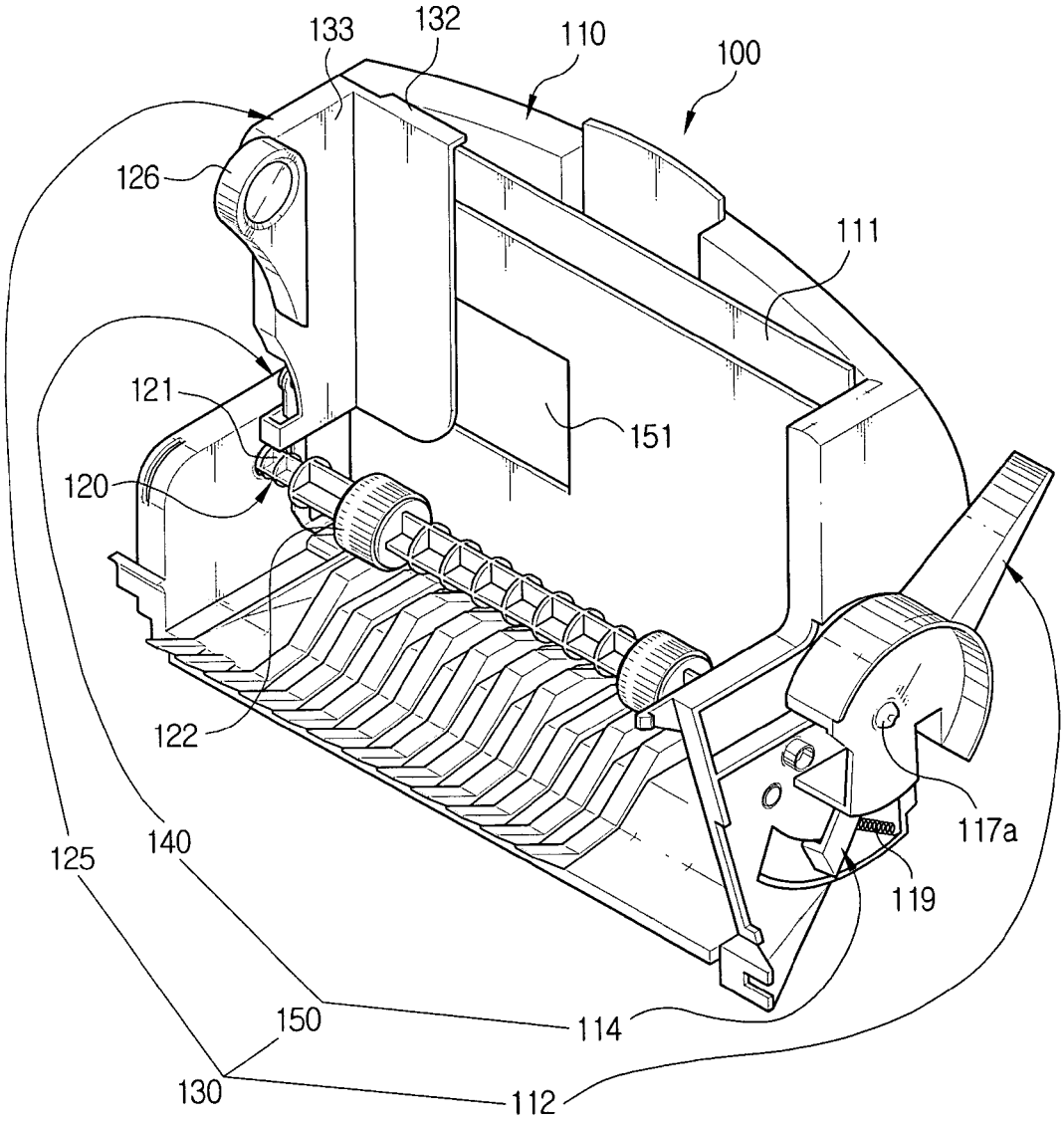
FIG. 2 is a perspective view of a paper feeding apparatus of an image forming apparatus according to an embodiment of the present invention.

Referring to FIG. 2, a paper feeding apparatus 100 of an image forming apparatus including an office machine according to an embodiment of the present invention will be described.

The paper feeding apparatus 100 includes a frame 110 serving as a paper tray that receives a plurality of paper sheets thereon. The paper feeding apparatus 100 includes a knock-up plate 111 resiliently supported to be lowered and raised, a pickup portion 120 having a pickup roller 122 rotating about a shaft 121 and formed above the knock-up plate 111 to pickup and feed a paper sheet from a paper stack of the knock-up plate 111, and a paper setting unit 130 aligning the paper sheets so as to prevent an undesirable movement of the paper sheets and guarantee accurate feeding of the paper sheets one by one.

The paper setting unit 130 is provided with a finger device portion 150 pressing on left and right corners of a leading end of the paper stack when the paper sheet is picked up by the pickup roller 122 so that the paper sheets can be separated from the paper stack one by one, a knock-up plate raising/lowering portion 112 raising and lowering the knock-up plate 111 with respect to the pickup roller 122, and a paper guide 125 slidably moving along the knock-up plate 111 to guide the paper sheets in accordance with a paper size.

The finger device portion 150 includes a first finger portion 114 mounted at a certain side, a right side in this instance, of the frame 110 with respect to the knock-up plate raising/lowering portion 112 to press one corner of the leading end of the paper, and a second finger portion 140 mounted at the other side, a left side in this instance, of the frame 110 with respect to the paper guide 125 to press the other corner of the leading end of the paper.

Figure 3:
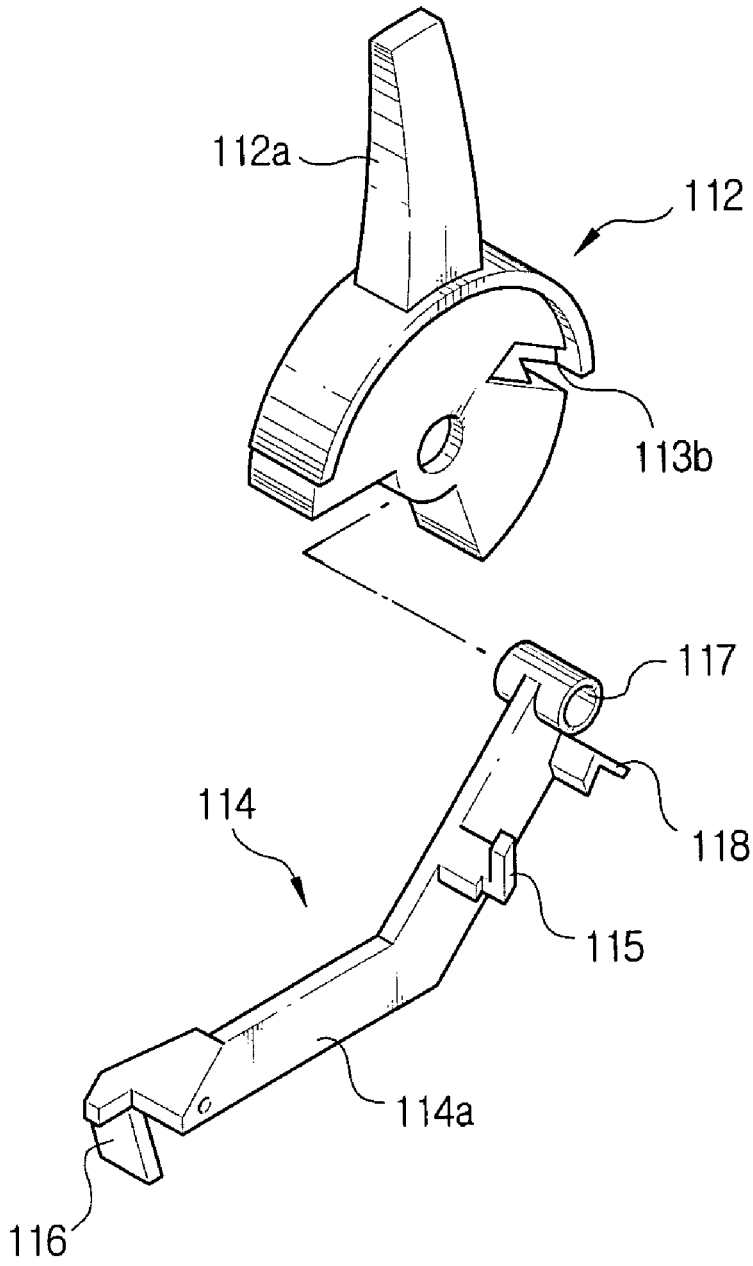
FIG. 3 is an exploded perspective view of a knock-up plate raising/lowering portion and a first finger portion of a paper setting unit of the paper feeding apparatus of FIG. 2.
Figure 4:
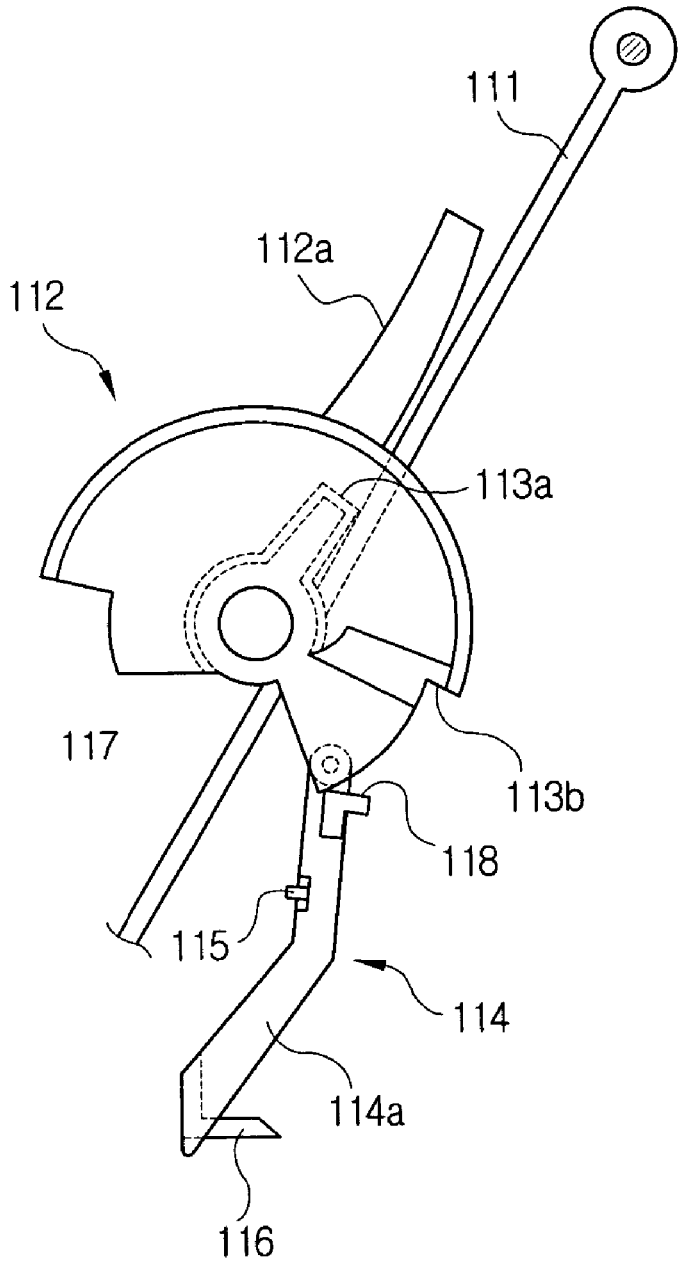
FIGS. 4 and 5 are side views showing the knock-up plate raising/lowering portion and the first finger portion of the paper setting unit of the paper feeding apparatus of FIG. 2.
Figure 5:
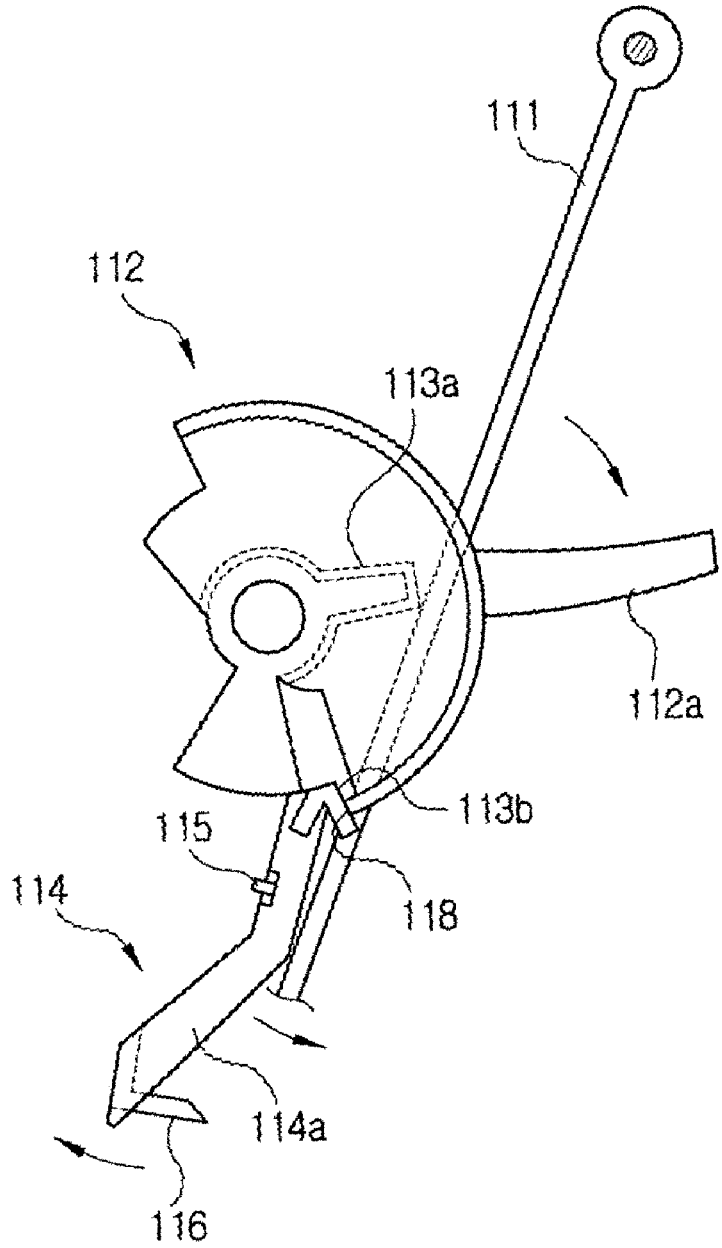

As shown in FIGS. 3 through 5, the first finger portion 114 includes a first operating lever 114*a* moving to or spacing away from the knock-up plate 111 when the knock-up plate 111 is raised by the knock-up plate raising/lowering portion 112, i.e., when the knock-up plate raising/lowering portion 112 is rotated, and a first resilient returning member 119 that returns the first operating lever 114*a* toward the knock-up plate 111 during ascending the knock-up plate 111.

The first operating lever 114*a* is formed as a first L-shape bar having a first hinge shaft receiving hole 117 that receives the first hinge shaft 117*a* hingedly supported on the frame 110, and a claw 116 that presses a corner of the leading end of the paper sheet.

The first operation lever 114*a* further has a first operating member 118 formed as a L-shaped projection in a vicinity of the first hinge shaft receiving hole 117 to be moved close to or spaced apart from the knock-up plate 111 in an engagement with a second locking member 113*b* that will be described later.

The first resilient returning member 119 is formed as a tension spring arranged between the frame 111 and a spring supporting projection 115 of the first lever member 114*a* that constitutes the first operating lever 114.

The knock-up plate raising/lowering portion 112 includes a release lever 112*a* having a first locking member 113*a* protruding toward the knock-up plate 111 so as to be moved in association with the knock-up plate 111 thereby to raise and lower the knock-up plate 111, and the second locking member 113*b* formed to be moved in association with the first operating member 118 thereby to raise and lower first lever member 114*a*.

Referring back to FIG. 2, the paper guide 125 is formed in a flattened U-shaped structure including a grip (handle) 126 protruding upward to move the paper guide 125 leftward and rightward, a guide portion 132 formed on a lower portion of the knock-up plate 111 to slidably move thereon leftward and rightward, and an aligning portion 133 having an aligning reference surface between the handle 126 and the guide portion 132 aligning the other end of the paper sheet.

Figure 6A:
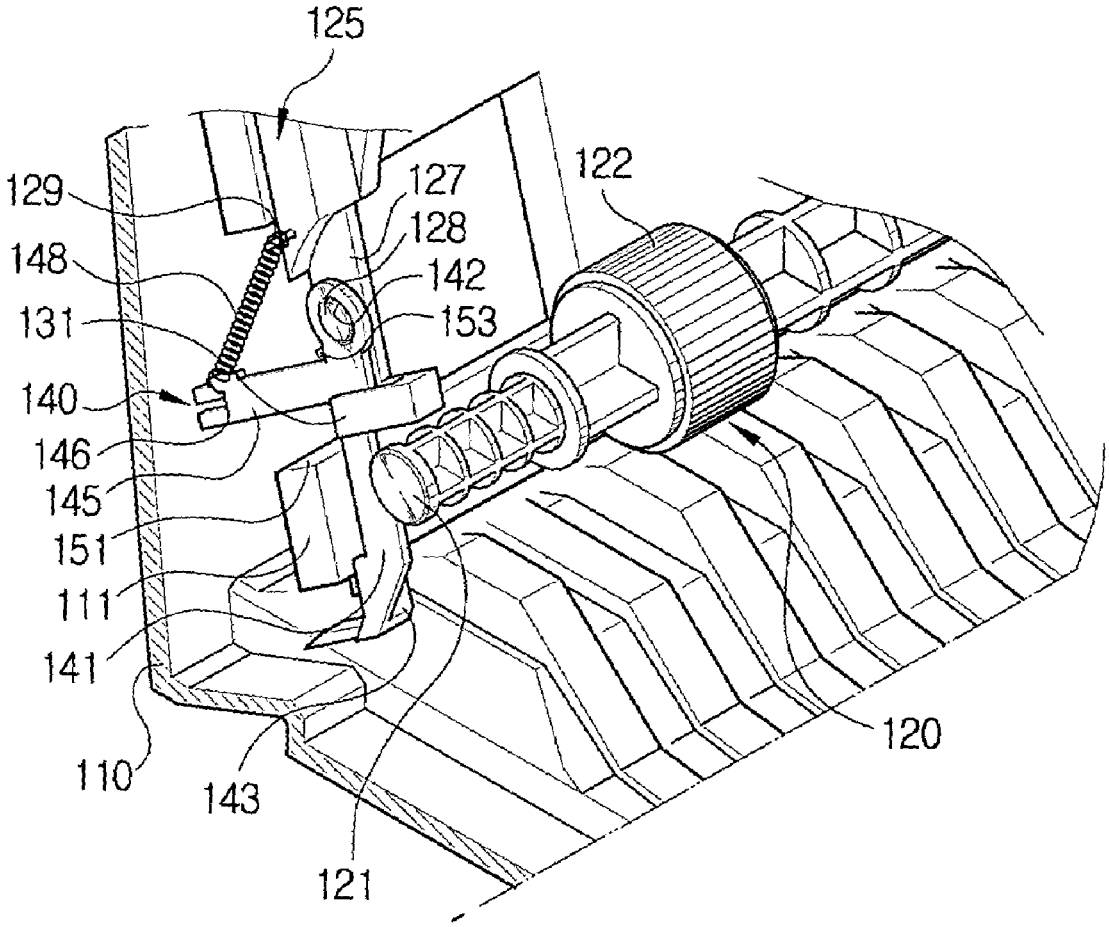
FIGS. 6A, 6B, 6C and 6D are perspective views of a second finger portion of the paper setting unit of the paper feeding apparatus of FIG. 2.

As shown in FIG. 6A, formed on a lower portion of the aligning portion 133 are a second finger portion receiving recess 127 having a second hinge shaft 128 on which a second finger portion 140 (described later) is pivotally disposed, and a flattened U-shaped stopper 131 restricting an ascending movement of a second operating lever 141 of the second finger portion 140.

Figure 6B:
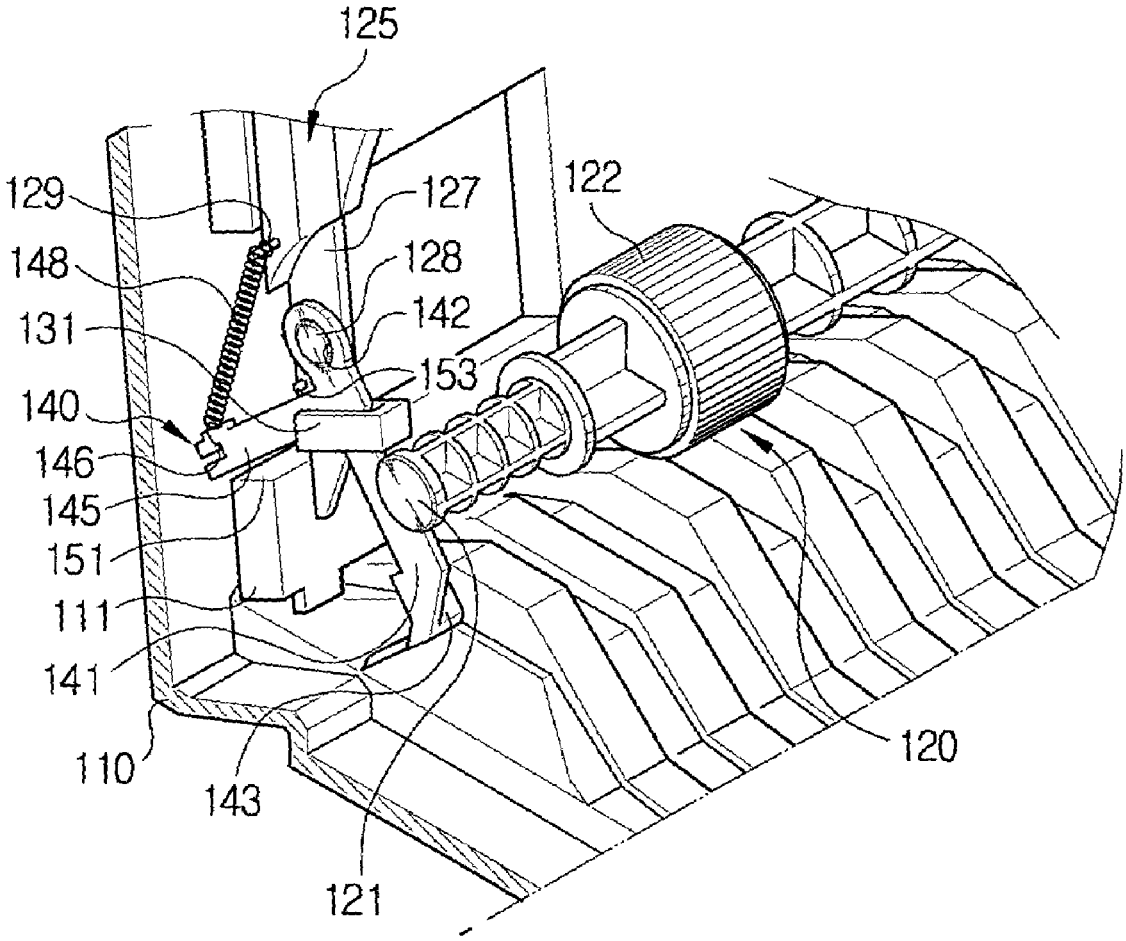

The second finger portion 140 is provided with the second operating lever 141 that is disengaged from the knock-up plate 111 when, as shown in FIG. 6B, the knock-up plate 111 is pushed down away from the pickup roller 122 by the knock-up plate raising/lowering portion 112 or by a user, and a second resilient returning member 148 elastically returning the second operating lever 141 towards the knock-up plate 111 when, as shown in FIG. 6A, the knock-up plate 111 is pushed upward to the vicinity of the pickup roller 122 by a pushing force of the knock-up plate raising/lowering portion 112 or by the user.

The second operating lever 141 is formed of a L-shaped bar having one end formed with a second hinge shaft receiving hole 142 hingedly supported on the second hinge shaft 128 of the paper guide 125, and the other end formed with a second claw 143 that presses the other corner of the leading end of the paper sheet.

The second operating lever 141 is further provided with a second operating member 145 protruding under the second hinge shaft receiving hole 142 towards the bottom surface of the frame 111.

The second operating member 145 is extended through an opening 151 of the knock-up plate 111 and spaced at a predetermined distance apart from a bottom surface of the frame 111 so that a first distance of the second operating lever 141 spaced away from the knock-up plate 111 is increased according to a second distance by which the knock-up plate 111 is spaced away from the pickup roller 122 by its descending movement.

The predetermined distance between the bottom surface of the frame 111 and the second operating member 145 is adjusted according to a position of a stopping protrusion 153 formed on the second finger portion receiving recess 127 of the paper guide 125 to restrict a pivotal movement of the second operating member 145 by the second resilient returning member 148, and the predetermined distance is in a range that does not cause the second operating lever 141 to be separated from the knock-up plate 111 in a certain distance range even when the knock-up plate 111 is spaced away from the pickup roller 122 by the descending movement. By doing so, the paper stack on the knock-up plate 111 can remain under a predetermined pressure by the second claw 143 of the second operating lever 141 when the knock-up plate 111 is not allowed to ascend by the paper stack between the knock-up plate 111 and the pickup roller 122 even when the knock-up plate 111 has been raised by the knock-up plate raising/lowering portion 112.

The second resilient returning member 148 is formed as a tension spring having one end secured in a spring supporting hole 146 formed in an end of the second operating member 145, and the other end of the tension spring is secured at a spring hook 129 formed on a side of the paper guide 125.

Figure 7A:
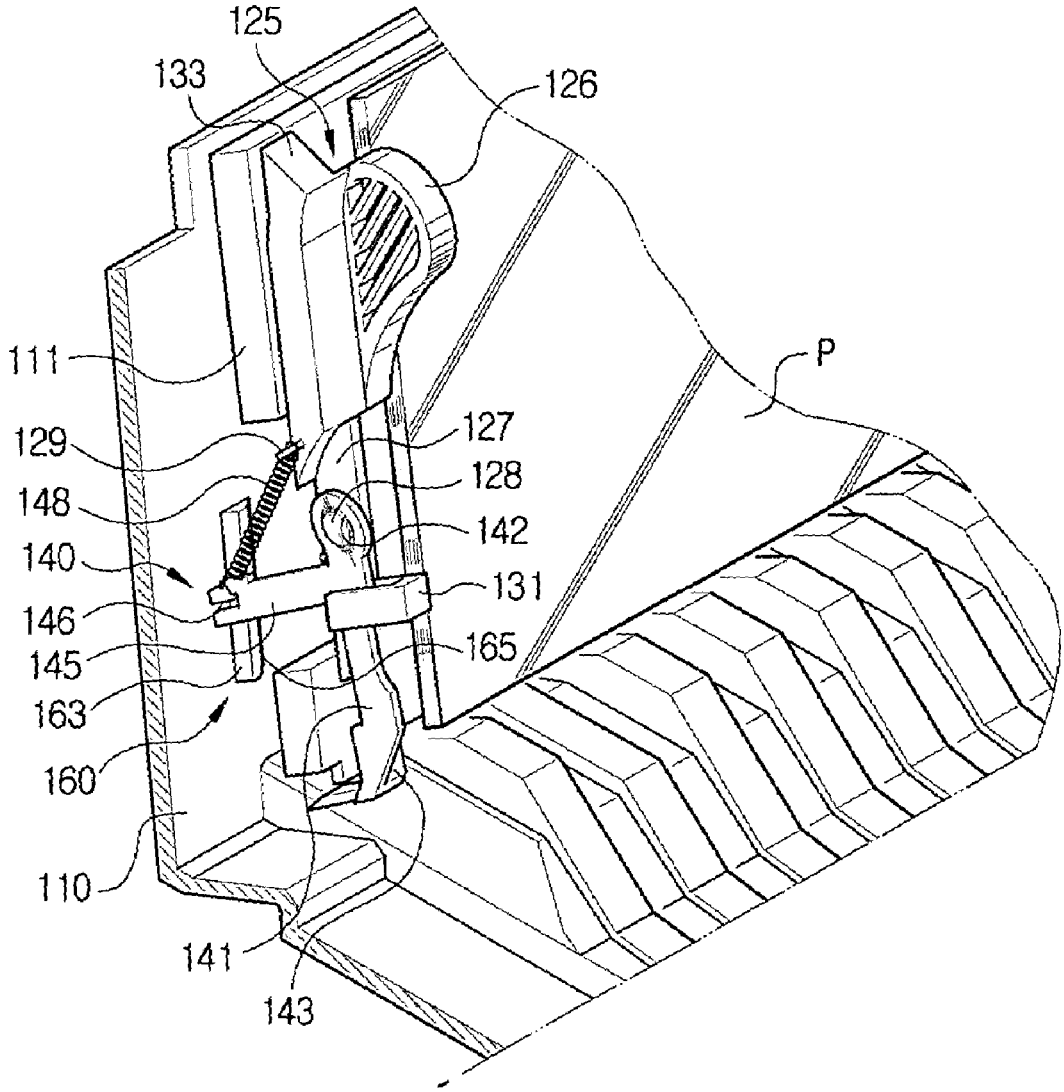
FIGS. 7A and 7B are perspective view of the finger raising/lowering device of the paper setting unit of the paper feeding apparatus of FIG. 2.

As shown in FIG. 7A, the paper setting unit 130 of the paper feeding apparatus 100 may further includes a finger raising/lowering device portion 160 that prevents the second finger portion 140 from being caught at the other corner, at the left corner in this instance, of the leading end of the paper sheet P when the paper guide 125 is moved to guide the paper sheet P with the knock-up plate 111 and the paper stack thereon being raised by the knock-up plate raising/lowering portion 112.

The finger raising/lowering device portion 160 is formed as an operating rib 161 formed on the frame 111 with respect to the second operating member 145 so as to raise the second operating member 145 of the second operating lever 141 against a recovering force of the second resilient returning member 148 when the paper guide 125 comes near to the side of the paper P. When the paper guide 125 comes in contact with the side of the paper P, the second claw 143 of the second operating member 145 of the second operating lever 141 pulled by the second resilient returning member 148 contacts the paper P with the predetermined pressure.

Figure 8:
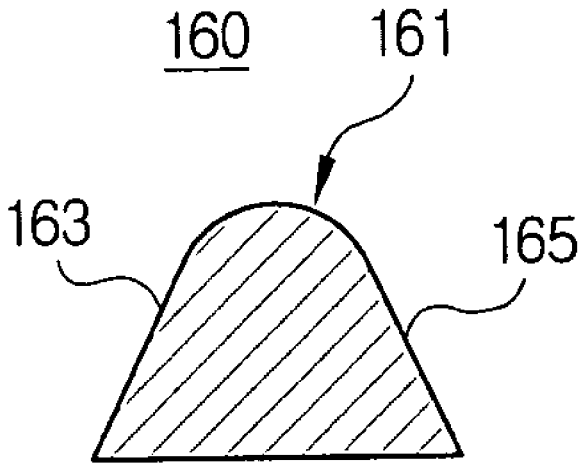
FIG. 8 is a sectional view of an operating rib of the finger raising/lowering device of the paper setting unit of the paper feeding apparatus of FIG. 2.

As shown in FIG. 8, for smooth sliding of the second operating member 145 along the operating rib 161, the operating rib 161 includes two symmetrical inclined surfaces 163, 165, which are arranged in a perpendicular relationship with respect to the advancing direction of the second operating member 145 within a movement range of the second operating member 145. The symmetrical inclined surfaces 163, 165 are inclined at a predetermined angle with respect to the advancing direction of the second operating member 145.

Although the operating rib 161 has been depicted in this embodiment as a single rib formed on the frame 111, it will be understood that there may be a plurality of ribs being arranged along the side of the paper P in accordance with a size of the respective papers being used in the printer, so as to prevent the paper guide 125 from being blocked due to the second finger portion 140 caught in the left corner of the leading end of the paper P when the paper P of a different size from a previously used paper P is being used.

As the paper guide 125 is moved to guide and align the side of the paper P with the knock-up plate 111, and the paper stack thereon is raised, the second finger portion 140 is raised by the finger raising/lowering device portion 160 if the paper guide 125 comes near to the side of the paper P, and then the second finger portion 140 is lowered to contact the paper P if the paper guide 125 comes into contact with the side of the paper P. Accordingly, the paper guide 125 is smoothly moved leftward and rightward without being hindered (blocked) by the second finger portion 140.

An operation of the paper feeding apparatus 100 of the image forming apparatus constructed as above according to the present invention will be described in detail with reference to FIGS. 2 to 8.

First, in order to efficiently receive the paper stack on the knock-up plate 111 of the frame 110 as the paper tray, the release lever 112*a* is rotated clockwise as shown in FIG. 5. As a result, the first locking member 113*a* of the release lever 112*a* pushes the knock-up plate 111 downward away from the pickup roller 122, while the second locking member 113*b* pushes the first finger portion 114 against a recovering force of the first resilient spring 119 in engagement with the first operating member 118, thus the first finger portion 114 is spaced-apart from the knock-up plate 111.

As the knock-up plate 111 is lowered downward, the second operating member 145 of the second finger portion 140 formed on the paper guide 125 is accordingly descended to the predetermined distance from the bottom surface of the frame 110, and then pushed upward against the recovering force of the second resilient returning member 148 to be in contact with the bottom surface of the frame 110. As a result, the second operating lever 141 is rotated about the first hinge shaft 128 counterclockwise from the position shown in FIG. 6A to the position shown in FIG. 6B.

Figure 6C:
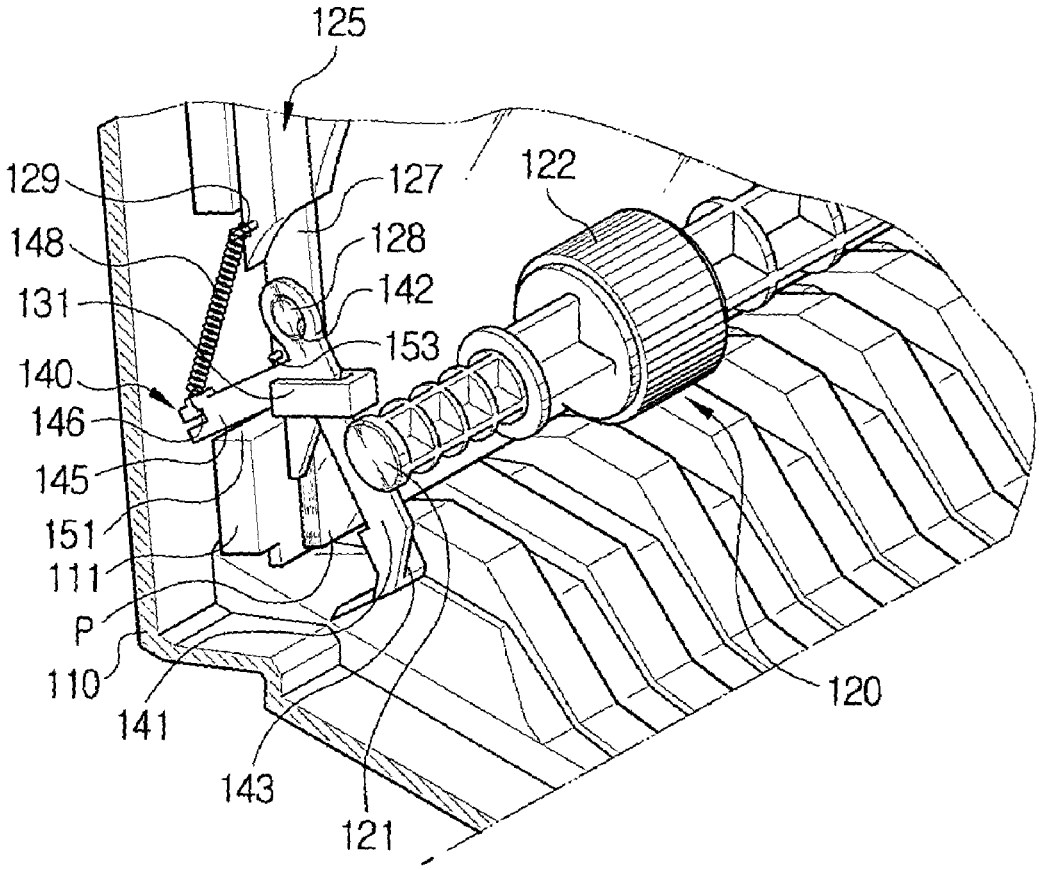

Then as shown in FIG. 6C, the papers P, A4 papers for example, are stacked on the knock-up plate 111.

After the papers P are stacked on the knock-up plate 111, the paper guide 125 is moved by the guide portion 132, which is slidably supported on the knock-up plate 111 to prevent a movement of the paper P in a transverse direction, to a side of the paper P so as for a alignment reference surface of the aligning portion 133 to be in contact with the side of the paper P.

As shown in FIG. 6C, since the second finger portion 140 is moved through the opening 151 of the knock-up plate 111 in a raised state, the paper guide 125 is smoothly moved leftward and rightward without being (blocked) by the second finger portion 140.

Then, the release lever 112*a* is rotated counterclockwise so as to set the papers P not to move.

As a result, as shown in FIG. 4, the first locking member 113*a* of the release lever 112*a* is spaced away from the knock-up plate 111, causing the knock-up plate 111 to be raised by the knock-up spring. Further, as the second locking member 113*b* is spaced away from the first operating member 118, the first claw 116 of the first finger portion 114 is made to press a corner, a right corner in this instance, of the leading end of the papers P with the recovering force of the first resilient returning member 119.

At this time, according to the ascending of the knock-up plate 111, the second operating member 145 of the second finger portion 140 is raised along with the knock-up plate 111 and thus spaced away from the bottom surface of the frame 110.

Figure 6D:
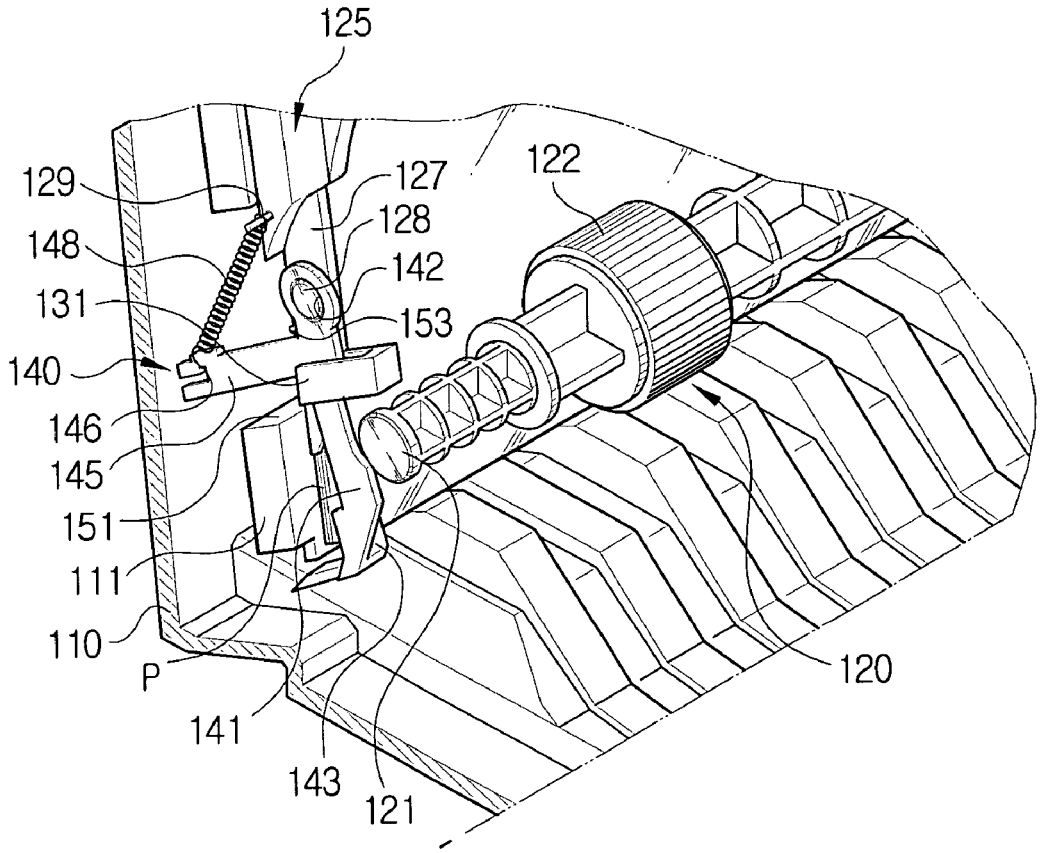

Accordingly, the second operating member 145 is pulled by the recovering force of the second resilient returning member 148 by a distance by which the second operating member 145 is spaced-apart from the bottom surface of the frame 110, and the second operating member 141 rotates about the first hinge shaft 128 in the clockwise direction to have the second claw 143 to press on the other corner, the left corner in this instance, of the leading end of the papers P with the predetermined pressure (FIG. 6D).

Meanwhile, if the setting of the paper guide 125 has not been performed to contact the alignment reference surface of the aligning portion 133 of the paper guide 125 with the side of the papers P after the user stacked the papers P on the knock-up plate 111, the paper guide 125 is moved to the side of the papers P in order to perform the setting process.

For a certain time that the paper guide 125 is in move, the second operating lever 141 of the second finger portion 140 is maintained at a predetermined interval with the knock-up plate 111, but then moved to lock with the side of the papers P as the paper guide 125 keeps moving.

As the paper guide 125 almost reaches the side of the papers P, as shown in FIG. 7A, the second operating member 145 of the second finger portion 140 slidably contacts the first inclined surface 163 of the operating rib 161 formed on the bottom surface of the frame 110 in the vicinity of the side of the papers P.

Accordingly, the second operating member 145 slides along the first inclined surface 163 to be raised upward against the recovering force of the second resilient returning member 148, and as a result, the second operating lever 141 is rotated about the second hinge shaft 128 in the counter-clockwise direction, to a height that is not locked with the side of the papers P.

Figure 7B:
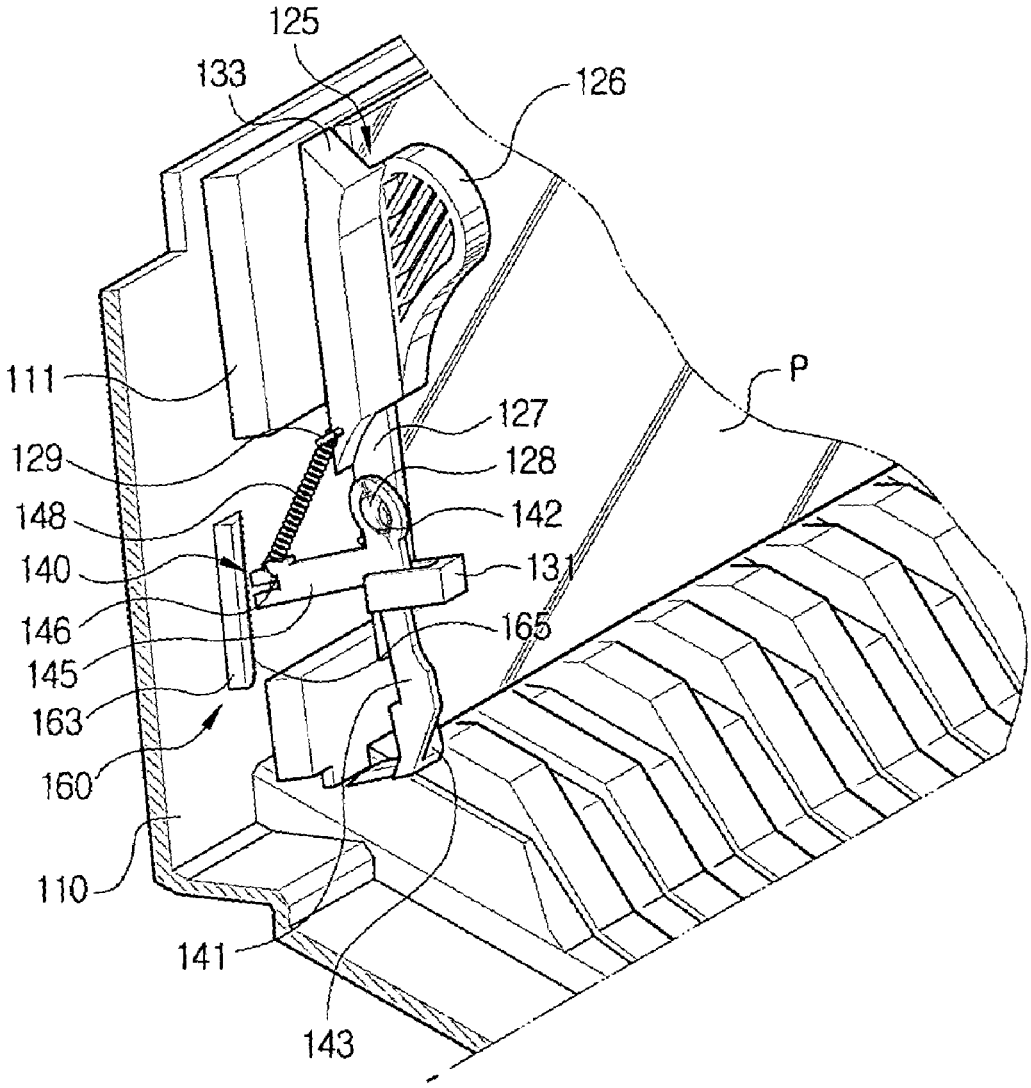

After that, as the paper guide 125 is slightly moved further to contact the side of the papers P, the second operating member 145 descends along the second inclined surface 165, and the second claw 143 of the second operating lever 141 presses on the left corner of the leading end of the papers P with the predetermined pressure as shown in FIG. 7B.

As described above, after the papers P are set by the paper guide 125 of the paper setting unit 130 and the first and the second finger portions 114, 140, with the rotation of the pickup roller 122, left and right corners of the leading end of each paper P is released from the first and the second claws 116, 143 with a certain friction, and thus, the papers P are fed into the body of the image forming apparatus one by one.

As described above, by providing the first and the second finger portions to press on left and right corners of the leading end of the paper with the predetermined pressure, the papers can be picked up one-by-one, and accordingly, the paper feeding apparatus of the image forming apparatus according to the present invention does not have the problems, such as, paper skew, a paper jam, double-, or multi-sheet feed.

Further, by providing the second finger portion which is moved in association with the paper guide, the paper feeding apparatus of the image forming apparatus according to the present invention does not have the problems, such as the paper skew, the paper jam, the double, or multi-sheet feed regardless of the size of the paper being used.

Although a few preferred embodiments of the present invention has been described, it will be understood by those skilled in the art that the present invention should not be limited to the described preferred embodiments, but various changes and modifications can be made within the spirit and scope of the present invention as defined by the appended claims and their equivalents.

What is claimed is:

1. A paper feeding apparatus of an image forming apparatus having a frame, a knock-up plate movably mounted on the frame, and a pickup roller picking up a sheet of paper disposed on the knock-up plate, the paper feeding apparatus comprising:

a first finger device movably disposed on a first portion of the knock-up plate to contact a first end of the paper;

a second finger device movably disposed on a second portion of the knock-up plate to contact a second end of the paper;

a paper guide slidably supported on the knock-up plate; and a knock-up plate raising/lowering portion moving with respect to the frame to raise and lower the knock-up plate with respect to the pickup roller, wherein the first and second finger devices move independently from each other, the second portion of the knock-up plate is an open portion so that the movement of the second finger device does not interfere with the knock-up plate, the paper guide is slidably disposed on the knock-up plate to move toward and away from the knock-up plate raising/lowering portion according to a size of the paper disposed between the paper guide and a side of the knock-up plate, the knock-up plate raising/lowering portion moves in a first direction, and the paper guide moves in a second direction perpendicular to the first direction, and the first finger device moves in the first direction, and the second finger device moves in the first and second directions.

2. The paper feeding apparatus of claim 1, wherein the knock-up plate comprises first and second sides disposed opposite to each other with respect to a paper feeding direction.

3. The paper feeding apparatus of claim 1, wherein the first finger device moves according to a movement of the knock-up plate raising/lowering portion.

* * * * *